US007818974B2

(12) United States Patent
Kim et al.

(10) Patent No.: US 7,818,974 B2
(45) Date of Patent: Oct. 26, 2010

(54) AIR CONDITIONER

(75) Inventors: Moon Shin Kim, Changwon-si (KR); Jin Myeong Cho, Gimhae-si (KR); Chi Wan Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 705 days.

(21) Appl. No.: 11/154,509

(22) Filed: Jun. 17, 2005

(65) Prior Publication Data

US 2006/0021369 A1 Feb. 2, 2006

(30) Foreign Application Priority Data

Jul. 30, 2004 (KR) ..... 10-2004-0060172

(51) Int. Cl.
*F25D 23/12* (2006.01)

(52) U.S. Cl. ..... 62/262; 62/259.1

(58) Field of Classification Search ..... 62/262, 62/259.1, 248, 312, 314, 414, 419, 298, 465; 454/201, 186, 204, 216
See application file for complete search history.

(56) References Cited

U.S. PATENT DOCUMENTS 5,368,262 A * 11/1994 Garrity ..... 248/131
5,943,873 A * 8/1999 Chung ..... 62/262
6,412,298 B2 * 7/2002 Kang et al. ..... 62/262
6,761,343 B2 * 7/2004 Clark et al. ..... 248/674
2001/0037630 A1 * 11/2001 Eom ..... 55/467
2003/0209024 A1 * 11/2003 Lee ..... 62/262

FOREIGN PATENT DOCUMENTS

| | | | |
|---|---|---|---|
| CN | 1081316 | C | 3/2002 |
| JP | 3-96420 | A | 4/1991 |
| JP | 5-149613 | A | 6/1993 |
| JP | 10-332168 | A | 12/1998 |
| JP | 11-264396 | A | 9/1999 |
| KR | 10-2001-000001 | A | 1/2001 |
| KR | 10-2002-0009657 | A | 2/2002 |

* cited by examiner

*Primary Examiner*—Mohammad M Ali
(74) *Attorney, Agent, or Firm*—Birch, Stewart, Kolasch & Birch, LLP

(57) ABSTRACT

An air conditioner is disclosed, which is suitable for improving its configuration and facilitating its assembly. The present invention includes a cabinet via which air is sucked or blown, a shroud guiding an air flow within the cabinet, a motor provided within the cabinet to forcibly circulate the air within the cabinet, an air guide penetrated by a rotational shaft of the motor, and a motor mounter coupled to the shroud to securely mount the motor thereon. Accordingly, the assembly configuration is simple and the corresponding assembly process is convenient, the vibration of the motor can be minimized, the assembly is facilitated, and the migration of the cold or hot air can be securely cut off.

14 Claims, 6 Drawing Sheets

AIR CONDITIONER

This application claims the benefit of the Korean Patent Application No. P2004-060172, filed on Jul. 30, 2004, which is hereby incorporated by reference as if fully set forth herein.

BACKGROUND OF THE INVENTION

1. Field of the Invention

The present invention relates to an air conditioner. Although the present invention is suitable for a wide scope of applications, it is particularly suitable for improving its configuration and facilitating its assembly.

2. Discussion of the Related Art

Generally, an air conditioner consists of a compressor, a condenser, an expansion valve, and an evaporator, to provide a more pleasant indoor environment to a user. And, the air conditioner is a device for cooling/heating an indoor space or purifying air using a phase change of a refrigerant according to a thermodynamic cycle. Moreover, the air conditioner can be categorized into a separate type and a combined type.

The separate type air conditioner consists of an indoor unit, an outdoor unit, and a refrigerant pipe connecting the indoor and outdoor units together, in which the indoor and outdoor units are separated from each other for installation. In particular, a cooling/radiating device is provided to the indoor unit and a radiating/cooling device and a compressor are provided to the outdoor unit. The combined type air conditioner, which has the same function of the separate type air conditioner, builds an indoor unit and an outdoor unit in one body to be installed on a house window and the like.

FIG. 1 is a perspective diagram of a combined type air conditioner according to a related art, FIG. 2 is an exploded perspective diagram of a combined type air conditioner according to a related art, and FIG. 3 is a cross-sectional diagram of a combined type air conditioner according to a related art.

Referring to FIGS. 1 to 3, a combined type air conditioner according to a related art consists of a base 2, a cabinet 4 provided over the base 2, and an air guide 6 partitioning an internal space of the cabinet 4 into an indoor side space I and an outdoor side space O.

A front panel 9 configuring a front part of the combined type air conditioner is provided to a front side of the cabinet 4. Within the cabinet 4 provided are a compressor 12 changing a low-temperature and low-pressure state of a gaseous refrigerant into a high-temperature and high-pressure state and a condenser 14 condensing the gaseous refrigerant from the compressor 13 into a liquid refrigerant.

An expansion valve (not shown in the drawing) expanding the high-temperature high-pressure liquid refrigerant condensed by the condenser 14 into a low-temperature low-pressure two-phase refrigerant (mixture of liquid and gas) and an evaporator 16 evaporating the two-phase refrigerant having passed through the expansion valve are provided within the cabinet 4.

Outdoor intake ports 5 are provided to a lateral side and topside of the cabinet 4 forming the outdoor side space O to suck air, and its backside is open to blow air to an outdoor space.

The air guide 6 consists of a lower guide 7 provided on the base 2 and an upper guide 8 provided over the lower guide 7.

An indoor air intake port 10 is provided to a front side of the front panel 9 to suck indoor air. And, an indoor air blowing path his provided over the indoor air intake port 10.

An intake grill 10*a* is provided to the indoor air intake port 10, and a plurality of air shift louvers 11*a* are provided to the indoor air blowing path 11.

A plurality of the air shift louvers 11*a* include a right/left air shift louver adjusting a wind direction of air in right/left direction and a upward/downward air shift louver adjusting a wind direction of air in upward/downward direction.

The combined type air conditioner further consists of a motor 20 provided between the indoor side space I and the outdoor side space O to be fixed to the air guide 6. The motor 20 includes a front shaft 20*a* projected toward the indoor side space I and a rear shaft 20*b* projected toward the outdoor side space O.

A turbo fan 24 is connected to the front shaft 20*a* to forcibly circulate the indoor air to the evaporator 16, and an orifice 26 is provided to an intake side of the turbo fan 24 to accelerate a wind velocity of air.

A propeller fan 28 is provided to the rear shaft 20*b* to forcibly pass the outdoor air to the condenser 14. And, a shroud 30 is formed in rear of the propeller fan 28 to configure a passage of the outdoor air sucked by a rotation of the propeller fan 28.

An operation of the above-configured related art combined type air conditioner is explained as follows.

First of all, once the combined type air conditioner is actuated, the refrigerant circulates in a cooling cycle including the compressor 12, the condenser 14, an expansion mechanism (not shown in the drawing) and the evaporator 16. And, the bi-shaft motor 20 is driven to rotate the turbo fan 24 and the propeller fan 28.

If so, the front side indoor air of the combined type air conditioner is sucked in a rear direction by the rotation of the turbo fan 24 to pas through the air intake port 10 of the front panel 9. And, the indoor air passes through the evaporator 16 to lower its temperature and then passes through the orifice 26, the lower guide 7 and the upper guide 8 in turn. Thereafter, the indoor air passes through the air blowing path 11 of the front panel 9 to be blown to the front side of the combined type air conditioner again.

Meanwhile, the outdoor air is sucked into the intake ports 5 of the cabinet 4 by the rotation of the propeller fan 28 to pass through the shroud 30 and then passes through the condenser 14 to take heat from the refrigerant to be blown out to the outdoor space.

However, the above-explained related art air conditioner has the following problems or disadvantages.

First of all, it is difficult to assemble the motor of the related art air conditioner. In particular, a configuration for installing the motor is complicated.

Secondly, since cold/hot air flows backward due to the gap existing between the motor and an opening penetrated by the motor, cooling/heating efficiency of the related art air conditioner is lowered.

Thirdly, since the motor is fixed to the backside of the air guide, the intensity of the motor vibration transferred to the cabinet is raised in the related art air conditioner.

SUMMARY OF THE INVENTION

Accordingly, the present invention is directed to an air conditioner that substantially obviates one or more problems due to limitations and disadvantages of the related art.

An object of the present invention is to provide an air conditioner, by which an assembly process is simplified and by which a simple configuration of the air conditioner is provided.

Another object of the present invention is to provide an air conditioner, by which cooling/heating efficiency is enhanced by improving a configuration of the air conditioner.

Another object of the present invention is to provide an air conditioner, by which noise generated from vibration of a motor can be reduced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an air conditioner according to the present invention includes a cabinet via which air is sucked or blown, a shroud guiding an air flow within the cabinet, a motor provided within the cabinet to forcibly circulate the air within the cabinet, an air guide penetrated by a rotational shaft of the motor, and a motor mounter coupled to the shroud to securely mount the motor thereon.

Preferably, the motor mounter is provided between the shroud and the air guide and the motor mounter is built in one body of the shroud.

More preferably, the motor mounter includes a motor fixing portion to which the motor is fixed and at least one connecting arm connecting the motor fixing portion to the shroud. The motor mounter further includes a support member supporting the motor fixing portion.

More preferably, the support member includes at least one vertical plate provided under the motor fixing portion and a horizontal plat provided under the at least one vertical plate.

More preferably, a front plate is provided to a front side of the at least one vertical plate to allow the air guide to adhere closely thereto and to support the air guide. If either the air guide or the shroud is fixed, the front plate decides an assembly position of either the shroud or the air guide.

More preferably, the motor fixing portion is configured to enclose an outer circumference of the motor. A joining plate having a locking hole having a prescribed shape is projected from a rim of the motor. A boss is provided to a rim of the motor fixing portion to correspond to the locking hole. And, the locking hole and the boss are locked by a locking member having a prescribed shape.

Preferably, the air guide includes a lower guide having a drain plate to receive a condensed water generated from the air conditioner and an upper guide provided over the lower guide.

More preferably, a lower recess corresponding to the rotational shaft of the motor is provided to the lower guide and an upper recess is provided to the upper guide to confront the lower recess.

More preferably, the rotational shaft of the motor penetrates a hole configured with the lower and upper recesses confronting each other.

In another aspect of the present invention, an air conditioner includes a cabinet having an intake grill via which air is sucked and a blowing grill via which the air is blown, a front frame provided to a front side of the cabinet, a base on which the cabinet and the front frame are assembled, a shroud guiding an air flow within the cabinet, a motor provided within the cabinet to forcibly circulate the air within the cabinet, an air guide penetrated by a rotational shaft of the motor, and a motor mounter built in one body of the shroud to mount the motor thereon.

Preferably, the air conditioner further includes an indoor heat exchanger for heat exchange of an indoor air within a space configured by the cabinet and the base and an outdoor heat exchanger for the heat exchange of an outdoor air, wherein the air conditioner is a combined type air conditioner.

Preferably, the motor mounter includes a motor fixing portion enclosing an outer circumference of the motor to fix the motor thereto, a connecting arm connecting the motor fixing portion to the shroud, and a support member provided under the motor fixing portion to support the motor fixing portion.

More preferably, the air guide includes a lower guide having a drain plate to receive condensed water generated from the air conditioner wherein one portion of a blower fan for blowing the air is received therein and an upper guide provided over the lower guide wherein the other portion of the blower fan is received therein.

More preferably, a blowing guide is provided to the upper guide to guide the air to a blowing grill provided to the front frame.

More preferably, a lower recess corresponding to the rotational shaft of the motor is provided to the lower guide, an upper recess is provided to the upper guide to confront the lower recess, and the rotational shaft of the motor penetrates a hole configured with the lower and upper recesses confronting each other.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
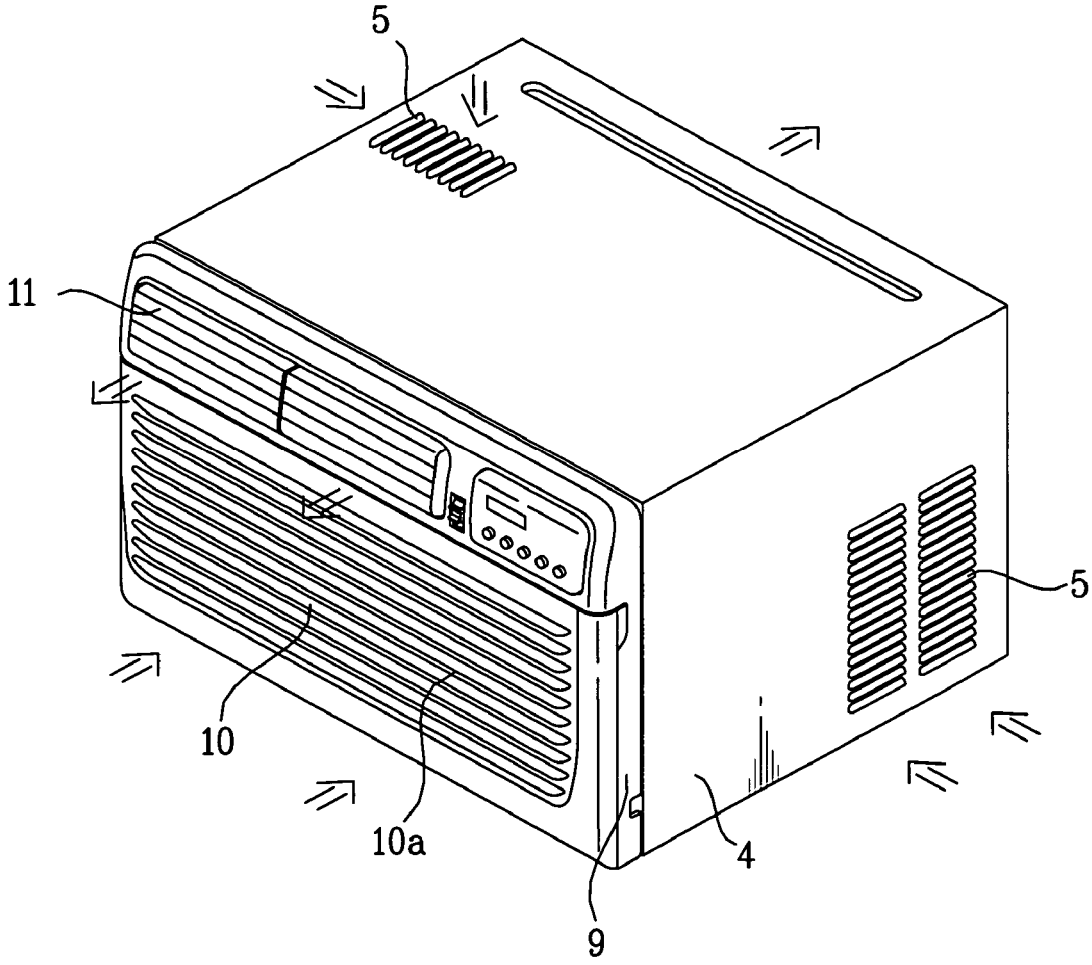
FIG. 1 is a perspective diagram of a combined type air conditioner according to a related art.
Figure 2:
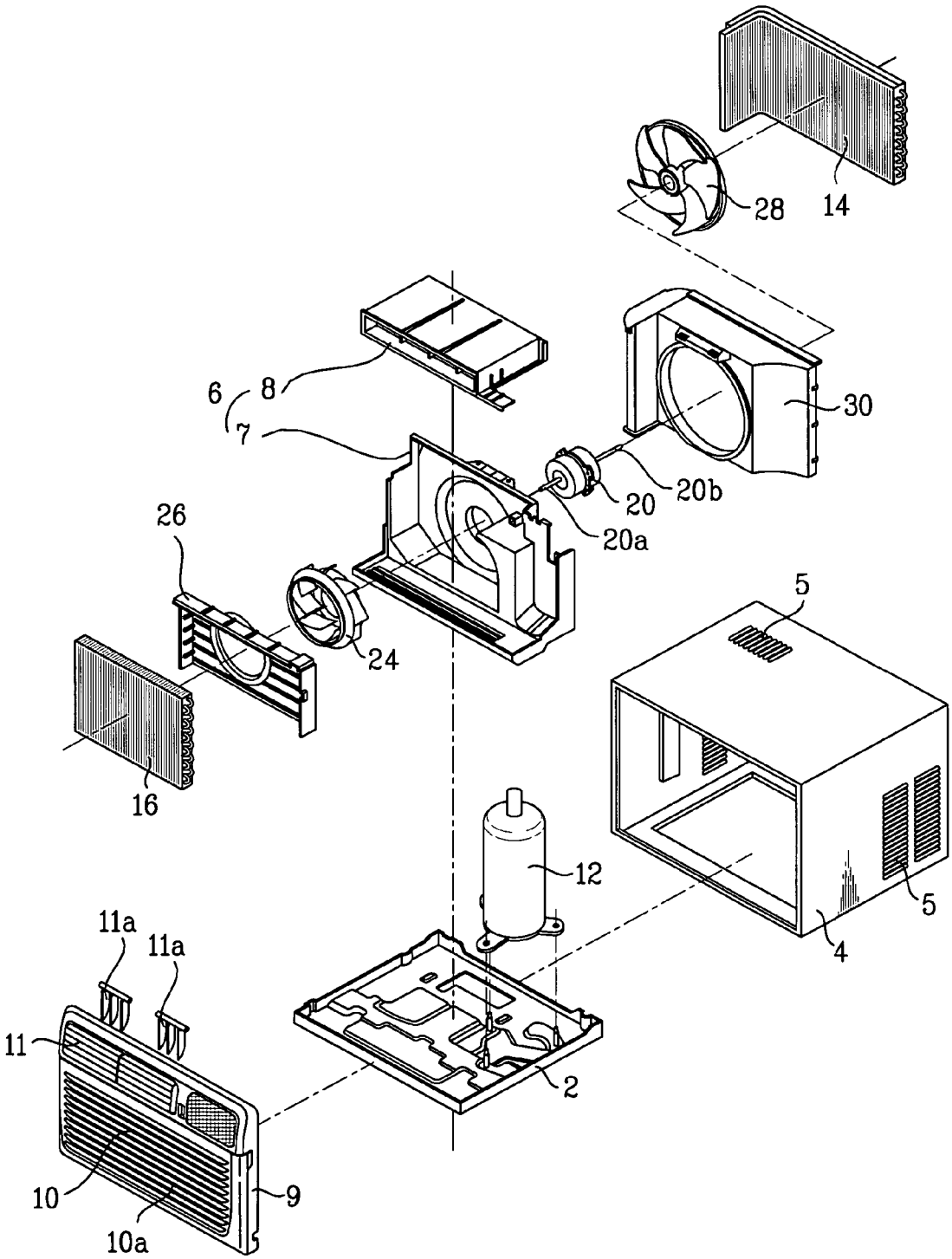
FIG. 2 is an exploded perspective diagram of a combined type air conditioner according to a related art.
Figure 3:
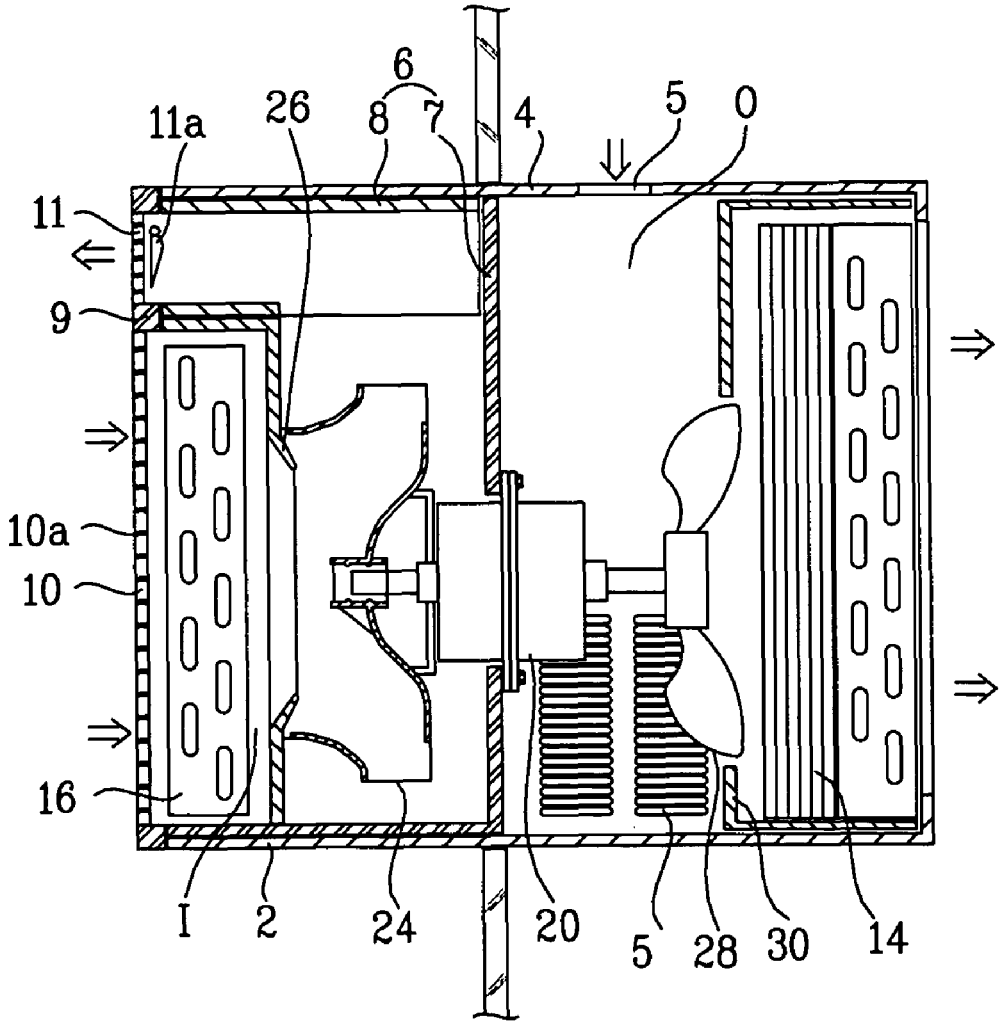
FIG. 3 is a cross-sectional diagram of a combined type air conditioner according to a related art.
Figure 4:
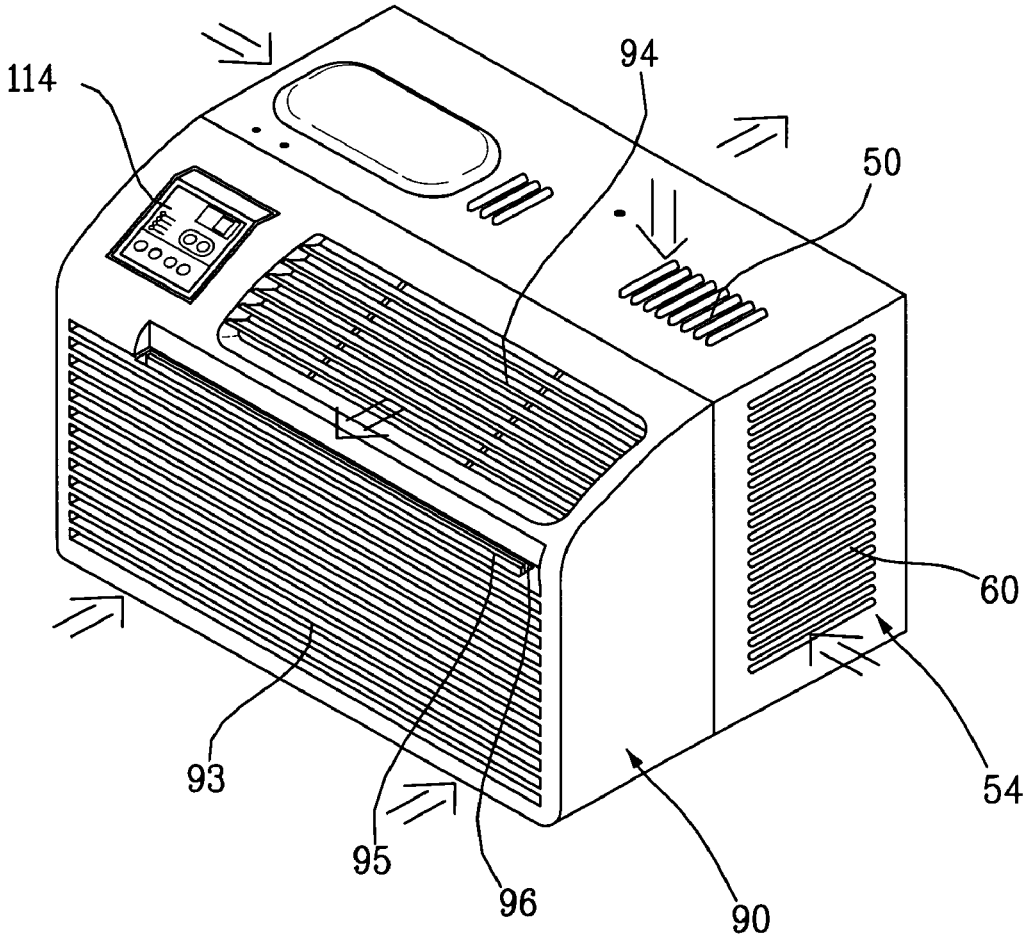
FIG. 4 is a perspective diagram of an air conditioner according to one embodiment of the present invention.
Figure 5:
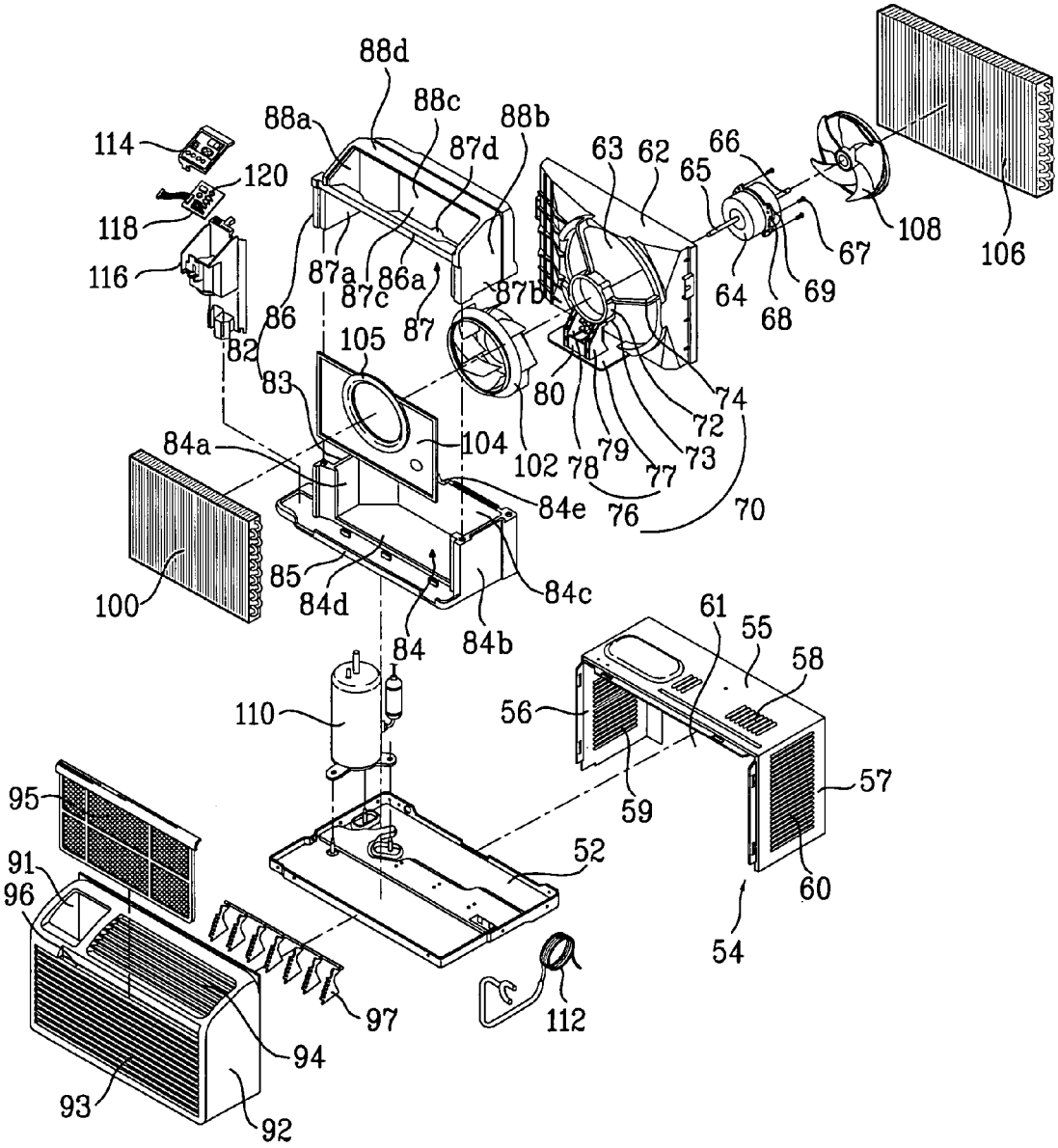
FIG. 5 is an exploded perspective diagram of the air conditioner shown in FIG. 4.
Figure 6:
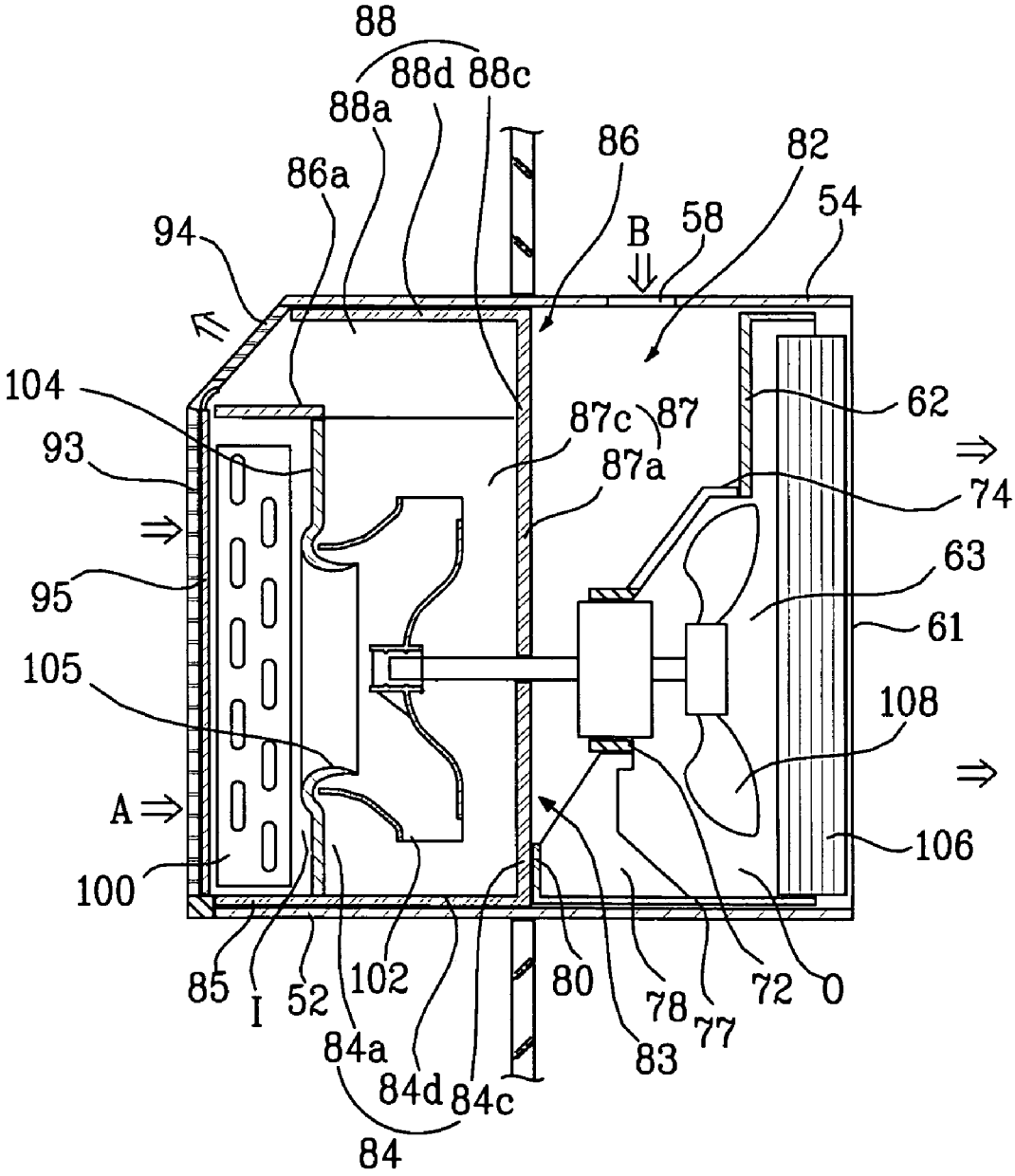
FIG. 6 is a cross-sectional diagram of the air conditioner shown in FIG. 4.

FIG. 4 is a perspective diagram of an air conditioner according to one embodiment of the present invention, FIG. 5 is an exploded perspective diagram of the air conditioner shown in FIG. 4, and FIG. 6 is a cross-sectional diagram of the air conditioner shown in FIG. 4.

Referring to FIGS. 4 to 6, an air conditioner according to one embodiment of the present invention includes a cabinet 54 in/from which air is sucked/blown, a shroud 62 guiding an airflow within the cabinet 54, a motor provided within the cabinet 54 to forcibly circulate the air within the cabinet 54, an air guide 82 penetrated by a rotational shaft of the motor 64, and a motor mounter 70 assembled to the shroud 62 to have the motor 64 mounted thereon securely.

An indoor heat exchanger 80 for heat exchange of an introduced indoor air and an outdoor heat exchanger 106 for heat exchange of an outdoor air are provided to the cabinet 54. In particular, an internal space of the cabinet 54 is partitioned into an indoor side space and an outdoor side space. The indoor heat exchanger 100 is installed within the indoor side space and the outdoor heat exchanger 106 is installed within the outdoor side space. A front frame 90 is provided to a front side of the cabinet 54, and the cabinet 54 and the front frame 90 are mounted on a base 52.

Yet, the present invention is not limited to the above-explained embodiment. Alternatively, the cabinet and the front frame are separated from each other to be installed on individual bases, respectively. Namely, the air conditioner according to the present invention is applicable to the separate type air conditioner as well as to the combined type air conditioner.

The cabinet 54 includes a topside part 55, a left lateral part 56, and a right lateral part 57. Lower ends of the left and right lateral parts 56 and 57 are fixed to left and right side ends of the base 52, respectively.

Intake grills 58, 59 and 60 are provided to the topside part 5, the left lateral part 56 and the right lateral part 57 of the cabinet 54, respectively. A backside part 61 of the cabinet 54 is open. Hence, an outdoor air is sucked into the cabinet 54 via the intake grills 58, 59 and 60, makes heat exchange with a refrigerant, and is then blown to the outdoor space via the backside part 61 of the cabinet 54.

The shroud 62 is provided within the cabinet 54 to guide ventilation of the sucked outdoor air. An opening hole 63 having a prescribed shape is formed at the shroud 61. One side of the opening hole 63 communicates with the intake grills 58, 59 and 60, while the other side of the opening hole 63 communicates with the outdoor air. And, the shroud 62 is fixed to the base 52 via a locking member such as a bolt and the like.

Meanwhile, the motor mounter 70 is built in one body of the shroud 62 so that the shroud 62 provides an installation location of the motor within the cabinet 54. And, the motor mounter 70 is located between the shroud 62 and the air guide 82. Alternatively, the motor mounter 70 can be provided within the shroud 62.

The motor mounter 70 includes a motor fixing portion 72 allowing the motor to be fixed thereto, a plurality of connecting arms 74 connecting the motor fixing portion 72 to the shroud 62, and a support member 76 supporting the motor fixing portion 72.

The motor fixing portion 72 has a circular strap shape enclosing an outer circumference of the motor 64, and a boss 73 having a prescribe shape is provided to a rim of the motor fixing portion 72.

The support member 76 includes at least one or more vertical plates 78 and 79 provided beneath the motor fixing portion 72 and a horizontal plate 77 provided under the vertical plates 78 and 79. And, a front plate 80 is provided to front sides of the vertical plates 78 and 79 to allow the air guide 82 to adhere closely thereto to be supported.

In particular, the horizontal plate 77 is horizontally projected forward from a lower end of the shroud 62 and the vertical plates 78 and 79 are vertically set between horizontal plate 77 and the motor fixing portion 72.

The front plate 80 is provided to front ends of the left and right vertical plates 78 and 79. If one of the air guide and the shroud is fixed, the front plate 80 plays a role in deciding an assembly position of the other.

Moreover, a tip of one side of the vertical plate contacting with the motor fixing portion 72 has a width smaller than that of the other side of the vertical plate contacting with the horizontal plate 77. Yet, the present invention is not limited to the embodiment. Alternatively, the number or shapes of the vertical plates can be arbitrarily selected.

Meanwhile, the motor 64 is mounted on the motor mounter 70 to forcibly ventilate the air sucked into the cabinet 54. In particular, the motor 64 is mounted on the motor fixing portion 72 to be fixed thereto.

The motor 64 is a bi-shaft motor including a front rotational shaft 65 projected in a front direction and a rear rotational shaft 66 projected in a direction opposite to the front direction. At least one joining plate 69 is projected from a rim of the motor 64 to join the motor 64 to the motor fixing portion 72. In particular, a locking hole 68 having a prescribed shape is provided to the at least one joining plate 69 to correspond to the boss 73 of the motor fixing portion 72. And, the boss 73 and the locking hole 68 are locked together by a locking member 67.

The air guide 82 plays a role in guiding an indoor air A as well as partitioning an internal space of the air conditioner into an indoor side space I and an outdoor side space O. The air guide 82 includes a lower guide 83 and an upper guide 86 arranged on the lower guide 83.

The lower guide 83 includes a lower fan housing 84 receiving a lower part of an indoor blower fan 102 blowing the indoor air therein and a drain plate 85 receiving condensed water falling from the indoor heat exchanger 100.

The lower fan housing 84 includes left/right lateral portions 84*a* and 84*b*, a rear side portion 84*c* and a lower side portion 84*d*, which enclose a lower part of the indoor blower fan 102. And, front and upper sides of the lower fan housing 84 are open.

The drain plate 85 is provided to a front lower end of the lower fan housing 84. And, a lower recess 84*e* is provided to one side of an upper end of the lower guide 83 to be penetrated by the front rotational shaft 65 of the motor 64.

The upper guide 86 includes an upper fan housing 87 receiving an upper part of the indoor blower fan 76 therein and a blowing guide 88 guiding the blown air.

The upper fan housing 87 includes left/right lateral portions 87*a* and 87*b* and a rear side portion 87*c*, which enclose an upper part of the indoor blower fan 102. And, front and lower sides of the upper fan housing 87 are open.

The blowing guide 88 plays a role in guiding the air blown by the indoor blower fan 102 to a blowing grill 94 provided to the front frame 90. A front side of the blowing guide 88 is open. And, the blowing guide includes left/right lateral portions 88*a* and 88*b*, a rear side portion 88*c*, an upper side portion 88*d* and a partition rib 86*a*.

The partition rib 86*a* plays a role in partitioning the upper fan housing 87 and the blowing guide 88. In particular, the partition rib 86*a* is formed long in right-to-left direction and has a prescribed width in front-to-rear direction to guide the blown air.

An upper recess 87*d* is provided to one side of a lower end of the upper guide 86 to confront the lower recess 84*e* of the lower guide 83 and to be penetrated by the front rotational shaft 65 of the motor 64. The front rotational shaft 65 of the motor 64 penetrates a hole configured by both of the lower and upper recesses 84*e* and 87*d* confronting each other.

Meanwhile, the front frame 90 is provided over a front part of the base 52 to suck the indoor air and to blow the sucked air into the indoor space. Lower ends of left and right lateral portions 91 and 92 of the front frame 90 are fixed to left and right ends of the base 52, respectively.

An intake grill 93 is provided to a front side of the front frame 90 to suck the indoor air, and a blowing grill 94 is provided to a plane tilted a prescribed angle from a plane of the intake grill 93. In particular, the plane in which the blowing grill lies is downwardly tilted at the prescribed angle.

A filter 95 is provided in rear of the intake grill 93 to purify the air having passed through the intake grill 93. A filter insertion slot 96 is provided to the front frame 90 to insert the filter 95 therein. Hence, the filter 95 slides up and down in the front frame 90 to be inserted in the filter insertion slot 96.

A plurality of louvers 97 are rotatably provided to the front frame 90 to adjust a wind direction of the air blown into the indoor space. In particular, the louvers 97 are provided in rear of the blowing grill 94.

Meanwhile, the air conditioner according to the present invention further includes an indoor heat exchanger 100, an indoor blower fan 102 assembled to the front rotational shaft 65 of the motor 64, and an orifice 104 provided to the air guide 82.

The indoor heat exchanger 100 is placed in front of the orifice 104. A passage portion 105 decreasing in diameter toward its rear side is provided to the orifice 104 to raise a speed and blown pressure of the air sucked by the indoor blower fan 102.

The indoor blower fan 102, which is a turbo fan sucking front air to blow to its circumference, is installed in the front sides of the lower and upper guides 83 and 86.

The air conditioner further includes an outdoor heat exchanger 106 provided within the cabinet 54, an outdoor blower fan 108 provided to the rear rotational shaft 66 of the motor 64, and a compressor 110 provided on the base 52 to compress a refrigerant.

A refrigerant pipe is provided within the cabinet to connect the indoor heat exchanger 100 to the outdoor heat exchanger 106. The refrigerant pipe includes a capillary tube 112 expanding the refrigerant.

Meanwhile, a control panel 114 is provided to the front frame 90 to control the air conditioner and to display operational information of the air conditioner. The control panel 114 is installed in a control box 116. And, a control board 118 including an electric part 120, which outputs a control signal for controlling the compressor 110 and the motor 64 according to an operation of the control panel 114 and an operational information signal to the control panel 114, inside is provided within the control box 116.

An operation of the above-configured air conditioner according to the present invention is explained as follows.

First of all, once the combined type air conditioner is actuated, the compressor 110 outputs a high-temperature high-pressure gaseous refrigerant. The outputted gaseous refrigerant passes through the outdoor heat exchanger 106 to radiate heat and to be condensed. The condensed refrigerant passes through the capillary tube 112 to turn into a two-phase refrigerant by being depressurized. The depressurized refrigerant passes through the indoor heat exchanger 100 to evaporate by absorbing heat from its surrounding and then circulates to the compressor 110.

Meanwhile, the motor is driven the moment the compressor 110 is driven, whereby the indoor blower fan is driven.

The indoor blower fan 102 is rotated to generate a negative pressure in a front side and the indoor air A in front of the front frame 90 is sucked via the intake grill 93 of the front frame 90. In doing so, the sucked air passes through the filter so that particles included in the air are filtered off.

Though the above process, the air sucked into the indoor side space I passes through the indoor heat exchanger 100 to make a heat exchange with the refrigerant. The heat-exchanged air passes through the passage portion 105 of the orifice 104 and is then introduced into the inner space of lower and upper guides 83 and 86. After a flowing direction of the air has been diverted by the lower and upper guides 83 and 86, the air is blown toward the blowing grill 94 of the front frame 90 to be blown toward an upper front side of the air conditioner.

Meanwhile, the outdoor blower fan 108 is rotated as soon as the motor 64 is driven, whereby a negative pressure is generated in front of the outdoor blower fan 108. Hence, the outdoor air B next to the cabinet 54 passes through the intake grills 58, 59 and 60 of the cabinet 54 to be sucked into the outdoor side space O that is the rear part within the air conditioner.

The outdoor air sucked into the outdoor side space O is sucked into the outdoor blower fan 108, is blown in a rear direction, and then passes through the opening hole 63 of the shroud 62. Thereafter, the air passes through the outdoor heat exchanger 106 to make a heat exchange with the refrigerant and is then blown to the rear side of the air conditioner via the backside of the cabinet 54.

Accordingly, the present invention provides the following advantages or effects.

First of all, as the motor mounter is built in one body of the shroud to mount the motor thereon, the assembly configuration is simple and the corresponding assembly process is convenient.

Secondly, since the motor mounter of the present invention includes the motor fixing portion to fix the motor thereto, the connecting arm between the shroud and the motor fixing portion, and the support member supporting the motor fixing portion, the motor can be securely supported and the vibration of the motor can be minimized.

Thirdly, as the front plate is installed, if one of the air guide and the shroud is fixed, an assembly position of the other is decided. Hence, the present invention facilitates the assembly.

Finally, as the rotational shaft of the motor is configured to penetrate the air guide, the present invention can securely cut off the migration of the cold or hot air.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An air conditioner comprising:

a cabinet via which air is sucked or blown;

a base onto which the cabinet is mounted;

a shroud configured to guide an air flow within the cabinet;

a motor provided within the cabinet to forcibly circulate the air within the cabinet;

an air guide penetrated by a rotational shaft of the motor, the air guide dividing an inside space of the air conditioner, the air guide comprising:

an upper guide, the upper guide having a fan housing and a blowing guide; and a partition separating the fan housing from the blowing guide; and a motor mounter coupled to the shroud to securely mount the motor thereon, the motor mounter comprising:

a motor fixing portion to which the motor is fixed, at least one connecting arm connecting the motor fixing portion to the shroud, and a support member connected between the motor fixing portion and the base to support the motor fixing portion from the base, the support member comprising:

at least one vertical plate extended from the motor fixing portion to the base in a vertical direction in order to directly support lower parts of the motor fixing portion, a horizontal plate provided under the at least one vertical plate and mounted on the base, and a front plate fixedly attached to the at least one vertical plate and the air guide, wherein the front plate is attached to the air guide in face-to-face contact, wherein the motor mounter is provided between the shroud and the air guide and wherein the motor mounter is built in one body of the shroud.

2. The air conditioner of claim 1, wherein a position of the front plate determines an assembly position of one of the shroud and the air guide when the other one of the air guide and the shroud is fixed.

3. The air conditioner of claim 1, wherein the motor fixing portion is configured to enclose an outer circumference of the motor.

4. The air conditioner of claim 3, wherein a joining plate including a locking hole having a prescribed shape is projected from a rim of the motor.

5. The air conditioner of claim 4, wherein a boss is provided to a rim of the motor fixing portion to correspond to the locking hole.

6. The air conditioner of claim 5, wherein the locking hole and the boss are locked by a locking member having a prescribed shape.

7. The air conditioner of claim 1, the air guide comprising:

a lower guide having a drain plate to receive a condensed water generated from the air conditioner; and an upper guide provided over the lower guide.

8. The air conditioner of claim 7, wherein a lower recess corresponding to the rotational shaft of the motor is provided to the lower guide and wherein an upper recess is provided to the upper guide to confront the lower recess.

9. The air conditioner of claim 8, wherein the rotational shaft of the motor penetrates a hole configured with the lower and upper recesses confronting each other.

10. An air conditioner comprising:

a cabinet having an intake grille via which air is sucked and a blowing grille via which the air is blown;

a front frame provided to a front side of the cabinet;

a base on which the cabinet and the front frame are assembled;

a shroud configured to guide an air flow within the cabinet;

a motor provided within the cabinet to forcibly circulate the air within the cabinet;

an air guide penetrated by a rotational shaft of the motor, the air guide comprising:

an upper guide, the upper guide having a fan housing and a blowing guide; and a partition separating the fan housing from the blowing guide; and a motor mounter built in one body of the shroud to mount the motor thereon, the motor mounter comprising:

a motor fixing portion enclosing an outer circumference of the motor to fix the motor thereto, a connecting arm connecting the motor fixing portion to the shroud, and a support member connected between the motor fixing portion and the base to support the motor fixing portion from the base, the support member comprising:

a plurality of vertical plates extended from the motor fixing portion to the base in a vertical direction in order to directly support lower parts of the motor fixing portion, a horizontal plate provided under the at least one vertical plate and mounted on the base, and at least one front plate fixedly attached to the plurality of vertical plates and the air guide, wherein the front plate is attached to the air guide in face-to-face contact.

11. The air conditioner of claim 10, further comprising:

an indoor heat exchanger for heat exchange of an indoor air within a space configured by the cabinet and the base; and an outdoor heat exchanger for the heat exchange of an outdoor air within a space configured by the cabinet and the base, wherein the air conditioner is a combined type air conditioner.

12. The air conditioner of claim 10, the air guide comprising:

a lower guide having a drain plate to receive a condensed water generated from the air conditioner wherein the lower guide receives a portion of a blower fan configured to blow the air; and an upper guide provided over the lower guide wherein the upper guide receives the other portion of the blower fan.

13. The air conditioner of claim 12, wherein a blowing guide is provided to the upper guide to guide the air to a blowing grille provided to the front frame.

14. The air conditioner of claim 13, wherein a lower recess corresponding to the rotational shaft of the motor is provided to the lower guide, wherein an upper recess is provided to the upper guide to confront the lower recess, and wherein the rotational shaft of the motor penetrates a hole.

* * * * *